US005350729A

United States Patent [19]

Londo et al.

[11] Patent Number: 5,350,729

[45] Date of Patent: Sep. 27, 1994

[54] DEVELOPER SHEET WITH STRUCTURED CLAYS AND PROCESS THEREOF

[75] Inventors: Michael G. Londo; Datta G. Mislankar, both of Chillicothe, Ohio

[73] Assignee: The Mead Corporation, Dayton, Ohio

[21] Appl. No.: 25,083

[22] Filed: Mar. 2, 1993

[51] Int. Cl.[5] ..... B41M 5/155

[52] U.S. Cl. ..... 503/225; 503/210; 503/211; 503/212; 503/214; 503/219

[58] Field of Search ..... 427/150; 503/207, 225, 503/210–212, 214, 219; 106/21 R, 21 E

[56] References Cited

U.S. PATENT DOCUMENTS

| | | | |
|---|---|---|---|
| 2,712,507 | 7/1955 | Green | 117/36 |
| 2,730,456 | 1/1956 | Green | 117/36 |
| 3,455,721 | 7/1969 | Phillips et al. | 117/36.2 |
| 3,466,184 | 9/1969 | Bowler et al. | 117/36.2 |
| 3,672,935 | 6/1972 | Miller et al. | 117/36.8 |
| 3,732,120 | 5/1973 | Brockett et al. | 117/16 |
| 3,737,410 | 6/1973 | Mueller | 260/59 |
| 3,900,216 | 8/1975 | Hayashi et al. | 282/27.5 |
| 3,928,702 | 12/1975 | Matsukawa et al. | 428/325 |
| 3,963,852 | 6/1976 | Baxter | 428/325 |
| 4,020,261 | 4/1977 | Oda et al. | 428/325 |
| 4,022,735 | 5/1977 | Thompson | 260/29.7 |
| 4,109,049 | 8/1978 | Thompson | 428/331 |
| 4,173,684 | 11/1979 | Stolfo | 428/581 |
| 4,226,962 | 10/1980 | Stolfo | 525/506 |
| 4,399,209 | 8/1983 | Sanders et al. | 430/138 |
| 4,405,371 | 9/1983 | Sugahara | 106/21 |
| 4,647,952 | 3/1987 | Pokora et al. | 346/210 |
| 4,742,041 | 5/1988 | Ikeda et al. | 503/200 |
| 4,952,278 | 8/1990 | Gregory et al. | 162/141 |
| 5,061,346 | 10/1991 | Taggart et al. | 162/175 |

*Primary Examiner*—B. Hamilton Hess

*Attorney, Agent, or Firm*—Thompson, Hine and Flory

[57] ABSTRACT

A developer composition containing a structured clay having a void volume greater than about 50%, a binder and a developer resin, and a developer sheet comprising a such developer composition on a support are described.

14 Claims, No Drawings

DEVELOPER SHEET WITH STRUCTURED CLAYS AND PROCESS THEREOF

FIELD OF THE INVENTION

This invention relates to a developer sheet for use in pressure-sensitive carbonless copy paper. More specifically, it pertains to improving image development while also increasing the surface strength of the developer sheet.

BACKGROUND OF THE INVENTION

Pressure-sensitive carbonless paper is well known in the art. See, for example, U.S. Pat. Nos. 2,712,507; 2,730,456; 3,455,721; 3,466,184; and 3,672,935. These papers include a developer sheet (also referred to as a CF sheet), which comprises a substrate which carries a coating containing an electron acceptor which reacts with the leuco dye transferred to the surface of the developer sheet to form an image.

One of the most typical examples of developer sheets, particularly in the U.S. market, employs a developer resin as the electron acceptor. One example of these developer sheets is described in U.S. Pat. No. 4,226,962 to Stolfo.

Conventional developer sheets often suffer from several drawbacks. The images created on the developer sheet are slow to form and are often weak in intensity. The coating compositions have a high viscosity. The developer sheets may also have a low binder concentration which decreases the surface strength and causes problems such as dusting, picks and piling.

SUMMARY OF THE INVENTION

A principal object of the present invention is to provide an improved coating formulation for use on a developer sheet and in pressure-sensitive carbonless paper.

In accordance with the invention, certain newly developed structured clays characterized by a void volume greater than about 50% are incorporated into developer resin coating compositions. These structured clays enhance absorption of the transferred oil containing the color precursor into the developer coating. As a result of the enhanced absorption, several improvements are possible. In particular, it is possible to use higher binder concentrations and thus enhance the surface strength of the coating and overcome problems such as dusting, picks and piling. It is also possible to reduce the amount of the developer resin (in some cases up to 25% of a conventional coating) and achieve comparable image intensity. It has also been found that coatings can be prepared having a higher solids content without increasing viscosity.

In accordance with the invention, it is also possible to use synthetic binders in place of, or in addition to, a natural binder such as starch and thus produce a sheet which has less tendency to degrade due to microbial growth or decay, thereby extending the self life of the developer sheet.

These and other objectives are obtained in the present invention which provides a developer sheet comprising a substrate having a developer coating on the surface, said coating including a structured clay, a developer resin, and a binder.

DETAILED DESCRIPTION OF THE INVENTION

The structured clays used in the present invention are characterized by their high void volume and their unique particle morphology. These structured clays may be thermally structured (calcined) or chemically structured and are referred to as structured pigments on the basis of their high level of void volume. In particular, the structured clays of the invention are characterized by a void volume of greater than about 50%. Typically these clays have a void volume of about 51% to 55%. Commercial examples of structured clays useful in the present invention are Ansilex-93, a calcined kaolin pigment having an irregular shape composed of platelets and large air void volumes and Exsilon-87, a chemically structured kaolin produced by using a cationic polymer to bulk hydrated kaolin both of which are available from Englehard. These structured clays can be used alone or in combination with each other. A combination of structured clays is often more economical and appears to provide better rheology characteristics.

The structured clay is used in an amount of about 65 to 75% based on the total solids or dry weight of the composition. In a more preferred embodiment, the structured clay is used in an amount of about 68 to 70%.

The developer resin used in the present invention is an electron accepting compound capable of reacting with a color-precursor to produce an image and can be selected from the developer resins which are known in the art. Illustrative examples of developer resins that can be used in the present invention include: acid polymers such as phenol-formaldehyde resins; phenol acetylene condensation resins; condensates between and organic carboxylic acid having at least one hydroxyl group and a formaldehyde; phenolic resins; oil soluble metal salts of phenol-formaldehyde novalak resins (e.g., see U.S. Pat. No. 3,672,935, 3,732,120 and 3,737,410) such as zinc modified oil soluble phenol-formaldehyde resin (see U.S. Pat. No. 3,732,120); methylene bridge-free phenolic resins described in U.S. Pat. No. 4,647,952; and mixtures thereof.

In a preferred embodiment, the developer resin used is a phenolic resin and, in a more preferred embodiment, it is a metallated phenolic resin such as HRJ 2969, a zincated resin of a higher alkyl phenol and salicylic acid which is available from Schnectady Chemical Inc.

The developer resin is used in an amount sufficient to react with a color precursor and form an image. Preferably, the amount of developer resin used is about 10% to 15% based on dry weight.

The binder used in the present invention is mixed with the developer resin and structured clay to form a developer coating. The binder acts as a film-forming material to enhance the surface strength of the coating as well as to adhere the coating to the substrate. The binder employed may be a natural binder, a synthetic binder or a combination thereof. In a more preferred embodiment, a synthetic binder is used along or in combination with other synthetic binders or with a natural binder. Synthetic binders are preferred because they are stronger than natural binders and the surface strength of the developer sheet can be maintained without affecting image development. Illustrative examples of synthetic binders include polyvinyl acetate and copolymers thereof, styrene butadiene rubber (SBR), polyvinyl alcohol, polystyrene, butadiene-styrene copolymers, polyvinylpyrrolidone, acrylic homo - or copolymers such as acrylic or methacrylic acids or lower alkyl esters thereof, e.g., ethyl acrylate, butyl acrylate and methyl methacrylate, acrylamide and the like. Illustrative examples of natural binders are gum arabic, casein, sodium alginate, methyl cellulose, carboxymethyl cellulose, dextrin, starch or modified starches, e.g., oxidized, hydrolyzed or hydroxyethylated starch, and the like. The preferred binders employed are starch and latexes.

The binder, is used in an amount of about 5% to 10% and preferably about 7% to 9%.

The developer sheet of the present invention can be used in combination with any conventional micro-capsule sheet also referred to as a CB or a CFB sheet.

A dispersing agent may be employed in the present invention to facilitate the dispersion of the structured clay into the developer resin. Representative examples of dispensing agents include polyacrylates such as Dispex N-40, manufactured by Allied Colloides, and Colloid-211, made by Rhone-Poulenc. Other dispersing agents include sodium metaphosphate, zinc hexametaphosphate, (calgon T, manufactured by Calgon Co.), polyphosphate salt such as sodium tripolyphosphate, and poly (sodium carboxylate). The dispersing agent is used in the invention at a concentration of about 0.1 to 1.0% by weight.

Other conventional additives in an amount effective for their particular purpose may be employed in carrying out the invention. For example, lubricating aids such as Flowco, a calcium stearate manufactured by Henkle Corp. is useful as a lubricant in blade coating applications.

It has been found that by using a preferred mixing sequence in preparing the developer compositions of the invention, it is possible to lower their their viscosity. In accordance with this sequence, the structured clay is first mixed with the binder and the developer resin and the latex is added last to this mixture. The latex has a tendency to precipitate out if the acidic developer resin is added directly to the latex. By mixing the developer resin with the binder and clay first, the ingredients can stabilize to a higher pH at which the latex has less tendency to precipitate.

The final mixture is applied to the surface of a substrate using conventional coating means. Illustrative examples of substrates are paper, film, etc. Paper is preferred.

The following non-limiting examples will further illustrate the present invention.

The following coating compositions were prepared in accordance with the above described mixing sequence and coated on a paper substrate at a coat weight of 1.5 pounds per ream using a Meyer rod.

| | Parts |
|---|---|
| Example 1 | |
| Dispex N-40 | 0.5 |
| Exsilon-87 | 51.2 |
| Ansilex-93 | 17.1 |
| Starch | 7.9 |
| HRJ 2969 | 13.4 |
| SRB latex | 7.9 |
| Dispex N-40 | 0.5 |
| Flowco | 1.5 |
| Example 2 | |
| Dispex N-40 | 0.5% |
| Exsilon-87 | 51.2% |
| Ansilex-93 | 17.1% |
| Polyvinylacetate | 7.9% |
| HRJ 2969 | 13.4% |
| SBR latex | 7.9% |

-continued

| | Parts |
|---|---|
| Dispex N-40 | 0.5% |
| Flowco | 1.5% |
| Comparison | |
| Calgon T | 2.5 |
| Clay (conventional) | 57.2 |
| Ansilex-93 | 6.6 |
| Starch | 7.9 |
| SBR latex | 7.0 |
| HRJ 2969 | 17.3 |
| Flowco | 1.5 |

The coatings were evaluated to determine the speed of the developing image and to determine the sensitivity of the coated sheet to process damage. The results are shown in the following table:

| | Comparison | Ex. 1 | Ex. 2 |
|---|---|---|---|
| Solid | 43.5% | 43.5% | 43.5% |
| Viscosity (at 75° F.) | 37.2 cps | 29.5 cps | 60.0 cps |
| 2-Minute Calendar Intensity (1) (a) | 44.1 | 36.6 | 40.8 |
| 24-Hour Calendar Intensity (1) (b) | 42.7 | 35.7 | 39.0 |
| 10-Minute Smudge (2) | 89.2 | 89.6 | 91.9 |

(1) The calendar intensity is a measure of the sensitivity level of a prepared coating at (a) 2-minutes after development at a controlled pressure and (b) 24-hours after development at a controlled pressure.
(2) The 10-minute smudge is a measure of frictional smudge properties of the coating 10-minute after calendering.

Having described the invention in detail and by reference to preferred embodiments thereof, it will be apparent that modifications and variations are possible without departing from the scope of the invention defined in the appended claims.

What is claimed is:

1. A developer sheet comprising a support having a developer composition on the surface thereof, said composition comprising a structured clay having a void volume greater than about 50%, a binder and a developer resin.

2. The developer sheet of claim 1 wherein said binder is a synthetic binder, a natural binder or a mixture thereof.

3. The developer sheet of claim 2 wherein said binder is selected from the group consisting of polyvinyl acetate, styrene butadiene copolymer, starch, gum arabic or mixtures thereof.

4. The developer sheet of claim 1 wherein said developer resin is a phenolic resin.

5. The developer sheet of claim 4 wherein said phenolic resin is a metallated phenolic resin.

6. The developer sheet of claim 1 wherein said developer resin is present in an amount of about 10% to 15%.

7. The developer sheet of claim 1 wherein said binder is present in an amount of about 5% to 10%.

8. The developer sheet of claim 1 wherein said structured clay is present in an amount of about 65% to 75%.

9. The developer sheet of claim 1 wherein said structured clay is a thermally structural clay, a chemically structured clay or a mixture thereof.

10. The developer sheet of claim 9 wherein said structured clay has a void volume of about 51% to 55%.

11. The developer sheet of claim 9 wherein said thermally structured clay is a calcined kaolin pigment.

12. The developer sheet of claim 11 wherein said calcined kaolin pigment has an irregular shape.

13. The developer sheet of claim 12 wherein said irregular shape comprises platelets.

14. The developer sheet of claim 9 wherein said chemically structured clay is produced by using a cationic polymer to bulk hydrated kaolin.

* * * * *